US006424942B1

(12) United States Patent
Mustel et al.

(10) Patent No.: US 6,424,942 B1
(45) Date of Patent: Jul. 23, 2002

(54) METHODS AND ARRANGEMENTS IN A TELECOMMUNICATIONS SYSTEM

(75) Inventors: Peter Mustel, Upplands Väsby; Ingemar Johansson, Luleå, both of (SE)

(73) Assignee: Telefonaktiebolaget LM Ericsson (publ) (SE)

( * ) Notice: Subject to any disclaimer, the term of this patent is extended or adjusted under 35 U.S.C. 154(b) by 0 days.

(21) Appl. No.: 09/425,799

(22) Filed: Oct. 25, 1999

(30) Foreign Application Priority Data

Oct. 26, 1998 (SE) ..... 9803698

(51) Int. Cl.[7] ..... G10L 21/02; G10L 19/06

(52) U.S. Cl. ..... 704/233; 704/216; 704/226

(58) Field of Search ..... 704/233, 219, 704/230, 226, 216, 217, 218, 225, 227, 228, 263, 262

(56) References Cited

U.S. PATENT DOCUMENTS

| | | | | |
|---|---|---|---|---|
| 3,989,897 A | | 11/1976 | Carver | 179/1 P |
| 5,235,669 A | | 8/1993 | Ordentlich et al. | 395/2 |
| 5,487,087 A | | 1/1996 | McCree et al. | 375/245 |
| 5,630,016 A | | 5/1997 | Swaminathan et al. | 395/2.37 |
| 5,835,607 A | | 11/1998 | Martin et al. | 381/94.1 |
| 6,104,992 A | * | 8/2000 | Gao et al. | 704/220 |
| 6,163,608 A | * | 12/2000 | Romesburg et al. | 379/410 |
| 6,173,257 B1 | * | 1/2001 | Gao | 704/200 |
| 6,188,980 B1 | * | 2/2001 | Thyssen | 704/230 |
| 6,260,010 B1 | * | 7/2001 | Gao et al. | 704/229 |
| 6,330,533 B2 | * | 12/2001 | Su et al. | 704/219 |

FOREIGN PATENT DOCUMENTS

| | | |
|---|---|---|
| EP | 0668007 | 8/1995 |
| EP | 0786760 A2 | 7/1997 |
| EP | 0843301 | 5/1998 |
| SE | B-451938 | 12/1987 |
| WO | WO97/34290 | 9/1997 |

OTHER PUBLICATIONS

Krembel, L.; EPO Standard Search Report; App. No. SE 9803698; File No. RS 102005SE; May 27, 1999; pp. 1–2.

Wong, D.Y., et al.; "Spectral mismatch due to preemphasis in LPC analysis/synthesis;" IEEE Transactions on Acoustics, Speech and Signal Processing, Apr. 1980, USA, vol. ASSP–28, No. 2, pp. 263–264.

* cited by examiner

*Primary Examiner*—Richemond Dorvil
(74) *Attorney, Agent, or Firm*—Jenkens & Gilchrist

(57) ABSTRACT

A method and arrangement for telecommunication comprises that it is detected (120) whether an incoming signal is speech or background noise, and encoding (100, 110) and transmitting parameters characterising the incoming signal. In or before (103) in the encoding of the background noise, parameters are produced, which represent background noise having increased low frequency components. Thus, the incoming signal can be subjected (103) to a frequency tilting operation. The degree of increasing the low frequency components is determined by the maximum long term correlation of the incoming signal. This method and arrangement provides a better generation of comfort noise, when the input signal comprises low frequency sinusoids, such as engine noise from cars and trams.

29 Claims, 7 Drawing Sheets

METHODS AND ARRANGEMENTS IN A TELECOMMUNICATIONS SYSTEM

FIELD OF THE INVENTION

The present invention relates to a method and an arrangement for telecommunication, in particular for generating background noise and more particularly for generating at least one coefficient, which enables the provision of a typical background noise in the receiver end of a transmission line.

DESCRIPTION OF RELATED ART

In a speech codec for a digital cellular system using source controlled variable bit rates, different bit rates are needed for different input signals. The highest bit rate is needed for speech signals while non-speech signals need a lower bit rate in order to be reproduced well.

Coding of background noise should preferably use as low a bit rate as possible. For spread spectrum systems (e.g. CDMA) a main objective is to reduce the average bit rate and thereby the total system load, and for TDMA systems the objective is a more efficient use of the battery, although system load can also be important.

In digital cellular systems which makes use of DTX (Discontinuous Transmission), the switch to and from the DTX mode is controlled by a voice activity algorithm (executed by a VAD, Voice Activity Detector).

According to the G.729 recommendation of ITU-T, the VAD algorithm makes a voice activity decision every 10 ms in accordance with the frame size of the G.729 speech coder. A set of difference parameters is extracted and used for an initial decision. The parameters are the full band energy, the zero crossing rate and a spectral measure. The long-term averages of the parameters during non-active voice segments follow the changing nature of the background noise. A set of differential parameters is obtained at each frame. These are a difference measure between each parameter and its respective long-term average. The initial voice activity decision is obtained using a piecewise linear decision boundary between each pair of differential parameters. A final voice activity decision is obtained by smoothing the initial decision.

The output of the VAD module is either 1 or 0, indicating the presence or absence of voice activity. If the VAD output is 1, the G.729 speech codec is invoked to code/decode the active voice frames. The G.729 speech codec has a detector, which enables a SID to be transmitted only if required. On the contrary, a codec according to GSMEFR must transmit SID information at predetermined moments. However, if the VAD output is 0, the DTX/CNG algorithms described herein are used to code/decode the non-active voice frames. Traditional speech coders and decoders use comfort noise to simulate the background noise in the non-active voice frame. If the background noise is not stationary, a mere comfort noise insertion does not provide the naturalness of the original background noise. Therefore it is desirable to intermittently send some information about the background noise in order to obtain a better quality when non-active voice frames are detected. The coding efficiency of the non-active voice frames can be achieved by coding the energy of the frame and its spectrum with as few as fifteen bits. These bits are not automatically transmitted whenever there is a non-active voice detection. Rather, the bits are transmitted only when an appreciable change has been detected with respect to the last transmitted non-active voice frame.

At the decoder side, the received bit stream is decoded. If the VAD output is 1, the G.729 decoder is invoked to synthesize the reconstructed active voice frames. If the VAD output is 0, the CNG module is called to reproduce the non-active frames.

When the VAD flags that speech is present the systems works as normal, i.e. the speech coder codes speech and transmits parameters that describe every frame in the speech signal. A frame is often 10 ms or 20 ms long segments of the speech signal.

When the VAD flags that speech is not present then any of the three scenarios below are possible.

1) TDMA system: The transmitter is switched off and is only allowed to transmit a silence descriptor (SID) frame, say once every $20^{th}$ frame that describes the characteristics of the background noise.
2) CDMA system: The transmit power of the transmitter is decreased very much and, as a consequence, the possible bit rate is decreased in order to meet the demand for a low bit rate imposed by the power reduction, as the comfort noise parameter must be encoded with very few bits.
3) Internet based telephony & Voice storage systems: neither of the previous two. The number of transmitted packets is reduced in order to reduce the load on the network or in the case of voice storage, to reduce the storage need on e.g. a storage medium.

Often the signal spectrum and energy are averaged over several frames. However this approach seldom gives any information of the kind of environment in which the other speaker is located when having a conversation as the signal spectrum is averaged.

Another approach is not to average the signal spectrum and energy in order to avoid smearing the signal spectrum and increase the update rate at the cost of fewer bits per update in order to maintain a low average bit rate.

The two estimates are transmitted to the decoder, sometimes at regular intervals or when e.g. the signal spectrum has changed. The important issue is to consume not too many bits. In the decoder the spectrum and the energy estimates are interpolated in order to try to ensure smooth transmissions. As an excitation source to the STP filter, which normally models the signal spectrum, either white noise is used or randomised versions of fixed and adaptive codebooks are used. The term STP means Short Term Predictor, which is a model of the acoustic characteristics of the oral cavity.

U.S. Pat. No. 5,630,016 discloses a noise generating method during voice inactivity intervals. Said method provides background noise for discontinuous transceiver system during periods of voice inactivity. Said method also alleviates annoyance and discomfort to a listener caused by on and off switching artifacts between intermittent periods of voice activity during conversation. The method according to U.S. Pat. No. 5,630,016 does not describe the problem associated with background noise with tonal characteristics. By tonal characteristics is meant the amount of low frequency sinusoids in the input signal. One example of tonal characteristic is engine noise. A way of measuring the tonal characteristics is the maximum long term correlation.

EP-A-0843301 discloses a method for comfort noise generation for digital mobile terminal modifying random excitation by a spectral control filter so that the frequency content of comfort noise and background noise become similar, or causing the transmitter to replace non-noise speech coding parameters with median value parameters. This method provides audio signals having natural sound at the receiver but does not take into consideration the specific problems related to engine noise.

EP-A-0786760 discloses a method for providing comfort noise between speech bursts, which is more pleasing to a listener than without such, but does not take into account the specific problems related with engine noise from e.g. cars and trams.

U.S. Pat. No. 5,487,087 discloses an output fluctuation signal quantiser for digital encoding of e.g. speech, which models both the input signal and its time variation and modifies an error to include a term corresponding to the difference between current and previous input signals, forcing the quantiser to match the input signal fluctuation. It reduces noise e.g. the swirling effect and can be combined with insertion of comfort noise. However the document does not take into consideration the specific problems related to engine noise.

EP-A-0668007 discloses an acoustic signal processing installation for car telephones which determines auto and cross correlation functions for a Wiener filter in order to reduce the noise content in a microphone signal so that the speech quality of output signal is improved. However, this document does not disclose the generation of comfort noise.

SE-B-451938 discloses a speech detector filter for vehicle mobile telephones which works with loudspeaker type units, and has an attenuation which is reduced at frequencies up to 300 Hz and is increased at those over 3400 Hz. This filter may be used for speech detectors working in accordance with the semi-duplex principle in conjunction with vehicular mobile telephones, so that they react to speech signals but not to interference noise signals. However, this document does not disclose the generation of comfort noise.

U.S. Pat. No. 5,235,669 discloses code excited linear predictive techniques, which are adapted to wide band speech communication with an overall tilt of a weighting filter response decoupled from the response determined at particular format frequencies. However the use of a tilt filter in conjunction with the generation of comfort noise is not described.

SUMMARY OF THE INVENTION

When speaking in a telephone in an environment with engine noise from e.g. cars and trams, the generation of a background noise according to the state of the art methods is of insufficient quality. The reason is that these sounds incorporate a low frequency component, which is of harmonic nature and thus will not be regarded as noise. Often these problems are heard as a fluttering noise at the decoder end. Also the comfort noise is often perceived as being too bright in its appearance compared to the appearance of the signal encoded in higher bit rates.

One means of reducing the fluttering effect is to average both the signal spectrum and energy at the encoder end before quantizing, the drawback is however that e.g. babble noise (background noise of the conversation at e.g. a cocktail party) is badly reproduced. This also does not help the situation of the too bright sound very much.

In order to model low frequency harmonic noise either the STP order (i.e. the amount of coefficients in the synthesis filter) has to be very high or some kind of transform coding scheme has to be utilised. However such schemes generally require many bits to be encoded.

The invention relies on the fact that we know well when generation of the comfort noise will sound too bright. This is when the long term correlation is high, which is the case for engine noise. Thus we can utilise this knowledge and tilt the spectrum of the signal before the encoding procedure in order to alleviate the bright sound appearance of the generated comfort noise.

The documents U.S. Pat. No. 5,630,016, EP-A-0843301, EP-A-786760, U.S. Pat. No. 5,487,087 cited above disclose different methods for generating comfort noise. The deficiency with these documents is that they do not take into consideration the specific problems related to engine noise.

EP-A-0668007 and SE-B-451938 disclose arrangements for reducing noise from vehicle, but not in conjunction with the generation of comfort noise.

An object of the invention is to improve the naturalness of background noise.

A further object of the invention is to improve the quality of regenerated background noise at no cost in additional bit rate and at a low increase of complexity of coding.

A further object of the invention is to make switching from activity to inactivity mode in a speech codec implementation more seamless and therefore more acceptable for the human auditory system.

The aforesaid objects are generally achieved by tilting the spectrum of the signal before the encoding procedure in order to enhance the generation of comfort noise.

The aforesaid objects are achieved by a method and arrangement for telecommunication comprising the steps of detecting whether the incoming signal is speech or background noise, and encoding and transmitting the background noise. In the encoding of the background noise, parameters are produced, which represent background noise having increased low frequency components. Before the encoding of the background noise the incoming signal is subjected to a tilting operation in order to increase the low frequency components. The degree of increasing the low frequency components is determined by the maximum long term correlation of the incoming signal. One reason why this method provides a more natural reproduction of background noise is that the ear perceives tones as stronger than noise, even when the level is the same. Therefore it is possible to "cheat" the ear to hear better, if the spectrum is tilted a bit more at comfort noise.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be described in more detail with reference to preferred exemplifying embodiments thereof and also with reference to the accompanying drawings, in which.

DESCRIPTION OF PREFERRED EMBODIMENTS

Figure 1A:
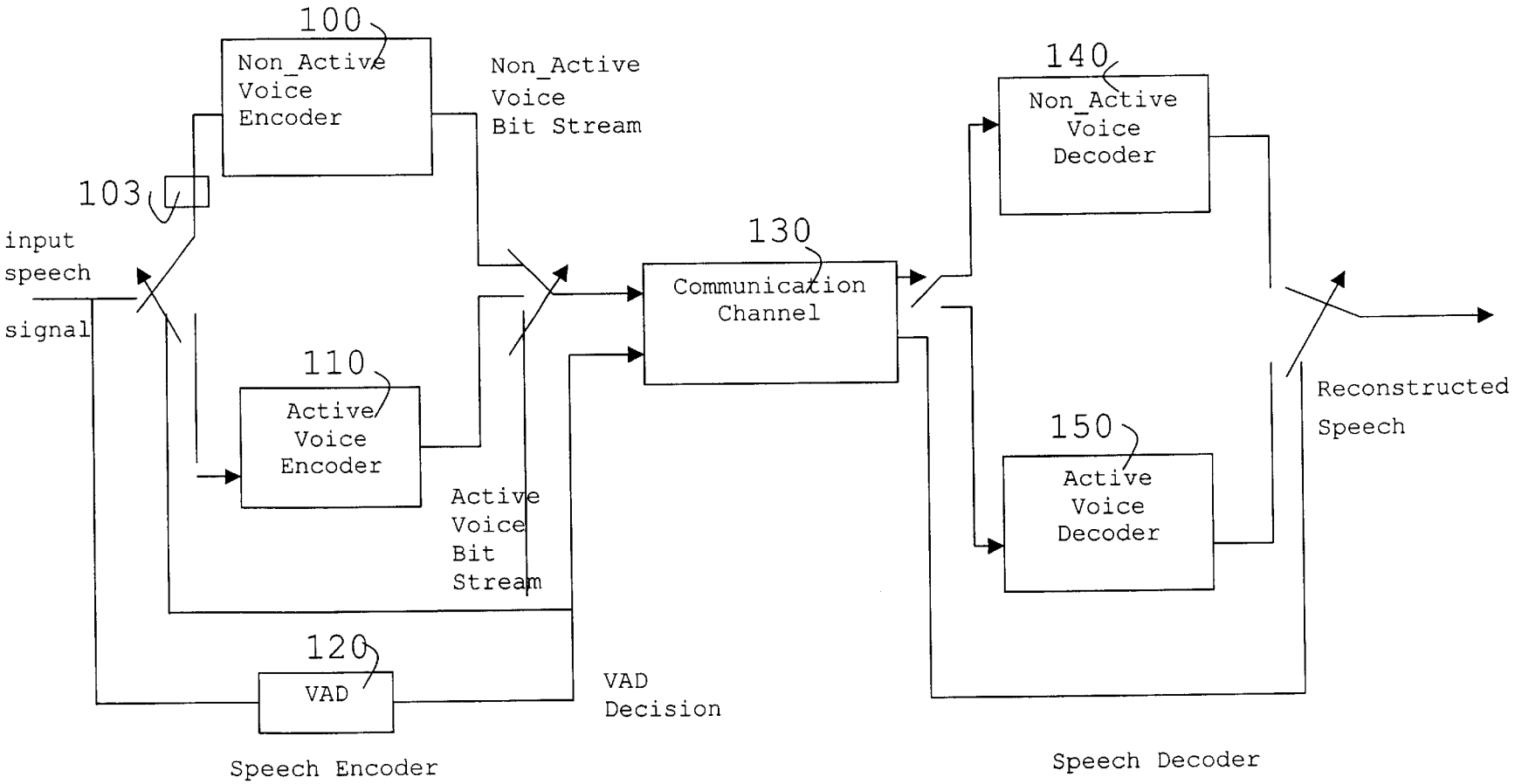
FIG. 1*a* shows a speech communication system with VAD.

In FIG. 1*a* is depicted a speech communication system using a VAD. At the speech decoder side is situated a VAD 120, which senses the incoming speech. The VAD controls through a switch the incoming speech to the Active Voice Encoder 110, when the incoming signal is speech, and to the Non_Active Voice Encoder 100, when the incoming signal is background noise. The output from the Non_Active Voice Encoder 100 is a Non_active Voice Bit Stream and the output from the Active Voice Encoder 110 is an Active Voice Bit Stream. Said Bitstreams are gated to a Communication Channel 130 according to the VAD decision. The output from the Communication Channel 130 is gated to the Non_Active Voice Decoder 140 or to the Active Voice Decoder 150, respectively, according to the VAD decision. The arrangement implementing the method according to the invention is situated in or at the Non_Active Voice Encoder 100. The method according to the embodiment of FIG. 2 is thus performed in block 103.

The invention relies on the fact that we know well when generation of the comfort noise will sound too bright. This is when the long term correlation is high, which is the fact for e.g engine noise. Thus we can utilize this knowledge and tilt the spectrum of the signal prior to the encoding procedure, as illustrated by the block diagram of FIG. 2. In this way the low frequency components are increased. In block 210, FIG. 2, an open loop LTP-analysis the long term correlation representing the amount of low frequency harmonic components of the input signal or any other means for determining the long term correlation, is made on the input signal. The LTP-analysis is well known to anyone familiar with the topic of speech coding. LTP means Long Term Predictor and is a model of the vocal cords. LTP-analysis is performed in a CELP-coder, which is a kind of coder. CELP means Codebook Excited Linear Predictive and constitutes the generic term for e.g. the recommendations G.729 and GSMEFR. Said coders are more fully disclosed below. Said recommendations disclose the function of an open loop LTP. The maximum long term correlation C is also calculated in block 210. In block 220, the maximum long term correlation C is used for computation of a coefficient a'. (The parameter C can e.g. be squared just to ensure that a' is close to zero when the maximum long term correlation C is low). a' is a non-smoothed tilt factor. In block 230, the a' coefficient is smoothed in order to alleviate the risk of a too fast changing tilt factor and thus a smoothed tilt factor is produced. In block 230 a gain factor G is calculated. The parameters a and G are generally computed from a function {a,G}=F(C) or even {a,G}=F($C^2$) the squaring of the maximum long term correlation C ensuring that a' will be close to zero for a low long term correlation. F(C) is an arbitrary function of C which returns the values of a and G. In block 240, the signal is tilted such that low frequencies are amplified when the background contains harmonic noise, i.e. where C is high. The signal is in block 250 scaled with the calculated gain G to ensure that the perceived level remains constant despite the tilt operation. The method according to FIG. 2 is, as already been mentioned, performed in block 103, see FIG. 1*a*.

Figure 2:
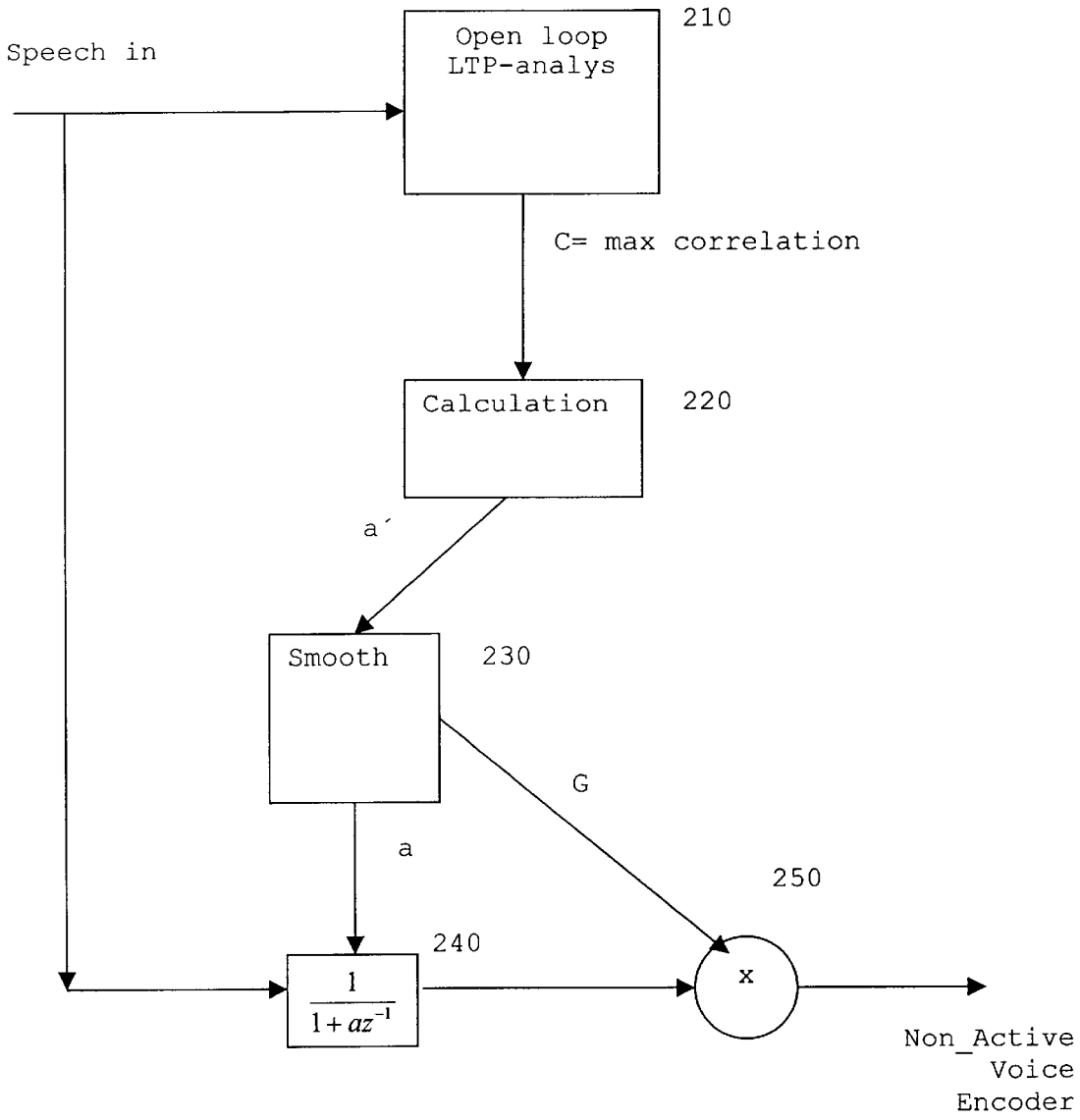
FIG. 2 shows a preferred embodiment of the invention.

An example formula of the function used in the blocks 220 and 230 in FIG. 2 is e.g:

$$a' = -\min(1.7C^2, 0.9) \quad (1)$$

$$a = 0.8a + 0.2a' \quad (2)$$

$$G = 1 + 0.7a \quad (3)$$

where the start value for a is selected in a suitable way, such as a=0.

A second example formula is $$a' = -\min(1.0, \max(0, C-0.3)/0.2)*0.7 \quad (4)$$

$$a = 0.8a + 0.2a' \quad (5)$$

$$G = 1 + 0.7a \quad (6)$$

where the start value for a is selected in a suitable way, such as a=0.

When using the second formula the a' value will ramp from zero up to −0.7 as C increases from 0.3 to 0.5, for values of C below 0.3 the a' value is zero and for values of C above 0.5 the a' value is −0.7.

Figure 1B:
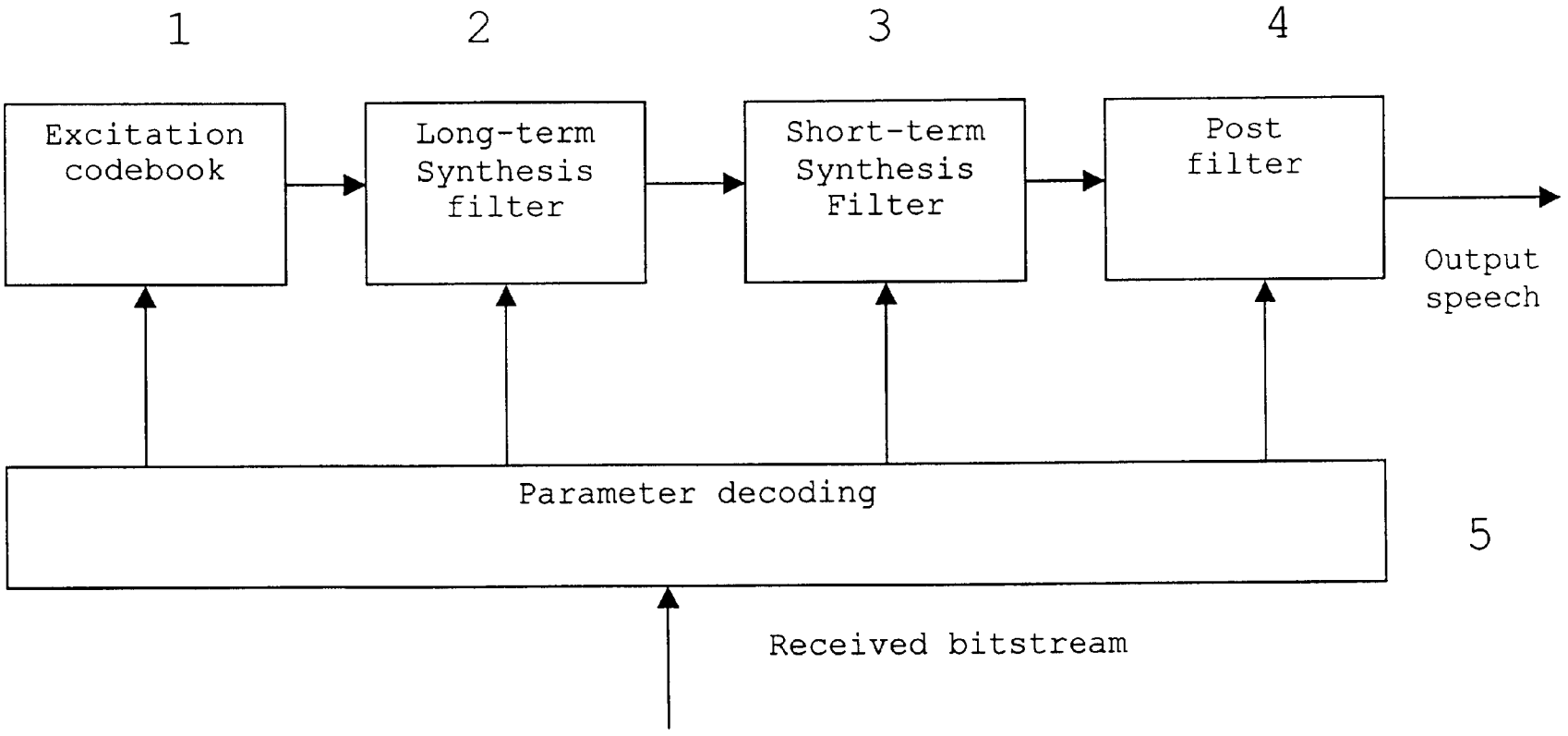
FIG. 1*b* shows a decoder using a CELP-method.

A decoder for speech or voice frames based on the Code-Excited Linear-Prediction (CELP) coding model is shown in FIG. 1*b*. The corresponding coder operates on speech frames of 10 ms corresponding to 80 samples at a sampling rate of 8000 samples per second. For every 10 ms frame, at the sending side, the speech signal is analysed to extract the parameters of the CELP model (linear-prediction filter coefficients, adaptive and fixed-codebook indices and gains). These parameters are encoded and transmitted. At the decoder, the coder parameters are used to retrieve the excitation and synthesis filter parameters, in block 1. The speech is reconstructed by filtering this excitation throught the short-term synthesis filter 3. The short-term synthesis filter 3 is based on a $10^{th}$ order Linear Prediction (LP) filter. The long-term, or pitch synthesis filter 2 is implemented using the so-called adaptive-codebook approach. After computing the reconstructed speech, it is further enhanced by a postfilter 4. The corresponding decoder for background noise is simular to the coder depicted in FIG. 1*b*, but deprived of blocks 2 and 4.

Although the above solution works well, it is not very handy to use in a DSP implementation (DSP: Digital Signal Processor). The reasons are among others:

1) Additional open loop LTP analysis has to be done besides the LTP analysis that is already done in the speech coder. This costs a lot both in terms of memory and computational complexity.
2) Both the original speech signal and the tilted speech signal occupy memory as the original speech signal is required for normal speech operation and the tilted speech signal is required for the computation of comfort noise parameters.

Figure 5A:
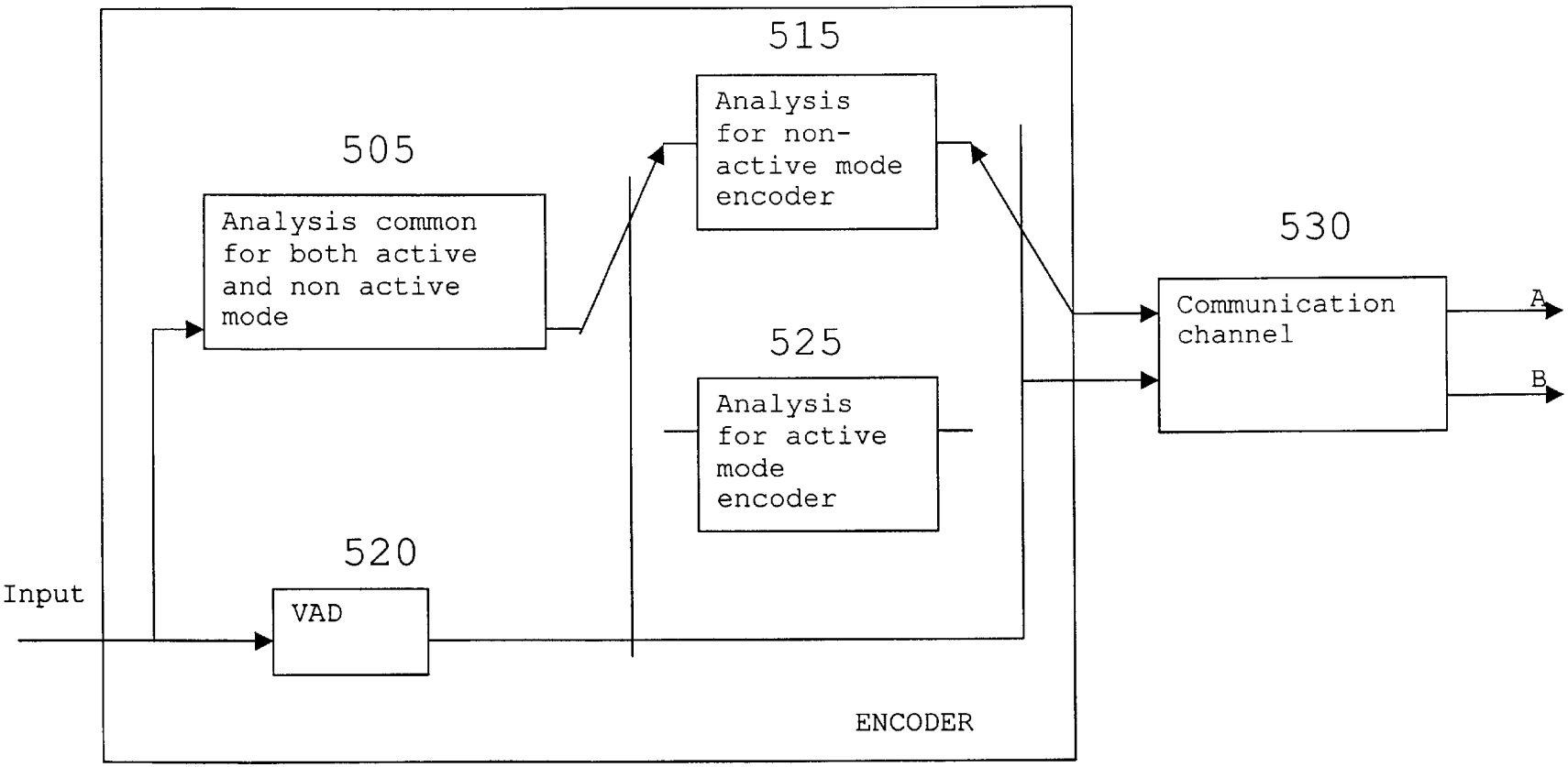
FIG. 5*a* shows an encoder according to a preferred embodiment according to the invention.
Figure 5B:
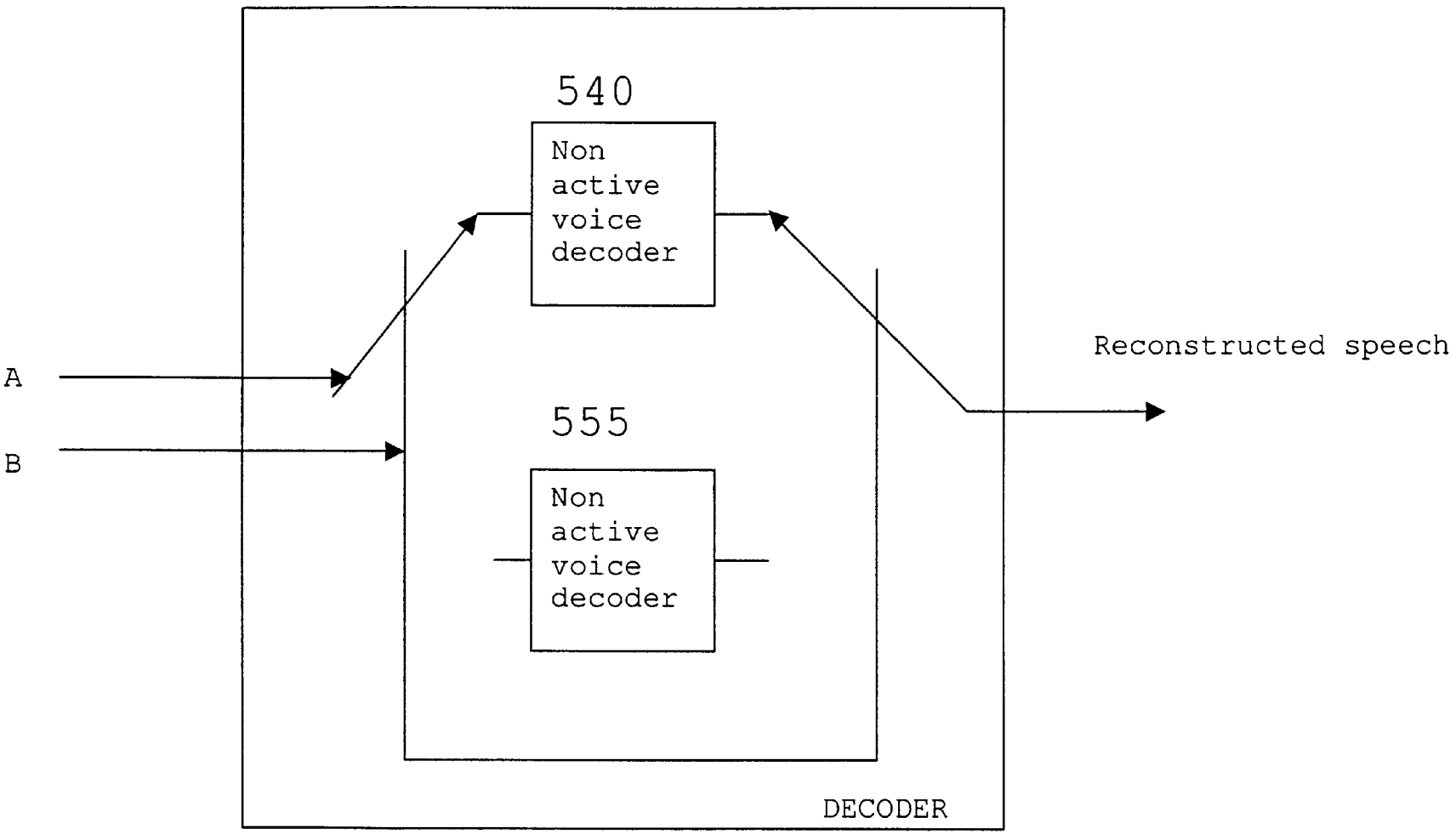
FIG. 5*b* shows a decoder according to a preferred embodiment according to the invention.

An encoder according to the preferred solution is shown in FIG. 5*a*, and a decoder according to the preferred solution is shown in FIG. 5*b*. The preferred solution is to make use of the existing STP (Short Term Predictor) parameters and the maximum long term correlation of the open loop LTP. In CELP coders an open loop LTP search is often done as a processing step before the closed loop LTP search. In this case the calculation of the open loop LTP maximum long term correlation is already performed in the speech coder, as in most standards for CELP-coding. First, at the encoder side, in block 505, an analysis common for both active and non-active mode is performed. In block 520, the VAD senses whether the incoming signal is background noise or speech. If the incoming signal is background noise the signal is transmitted to block 515, where an analysis for the non-active mode encoder is performed, and thereafter the signal is transmitted to the communication channel. If the incoming signal is speech, the signal is transmitted to block 525, where an analysis for the active mode encoder is performed, and thereafter the signal is transmitted to the communication channel. At the decoder side, the signal is transmitted to the non-active voice decoder 540, if the signal is background noise, or to the active voice decoder, if the signal is speech 555. The output signal from the decoder is reconstructed speech and background noise.

The formulation of the tilt filter in the z-domain corresponding to blocks 240 and 250, is $$T(z) = \frac{G}{1 + az^{-1}} \tag{7}$$

The existing STP coefficients from the encoder of speech are the coefficients of a synthesis filter in the decoder of the form $$H(z) = \frac{1}{1 + \sum_{n-1}^{N} b_n z^{-n}} \tag{8}$$

and are derived in the common analysis block 505 of FIG. 5*a*.

The synthesis is performed in the decoder from the parameters which are received, e.g. the parameters ($b_1 \ldots b_N$). The coefficients $b_1$–$b_N$ are normally quantized and are then transmitted to the receiver. In this disclosure the term "to quantize" means "to coarse". The order N is normally 10. Such a synthesis can also be done for the coefficient a, which will then require about 3 bits.

Figure 3A:
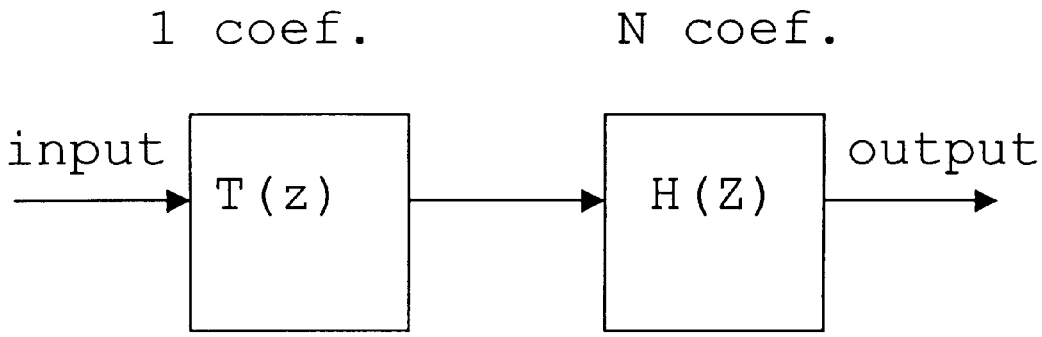
FIG. 3*a* shows a cascade coupling of a tilt filter and a synthesis filter.
Figure 3B:
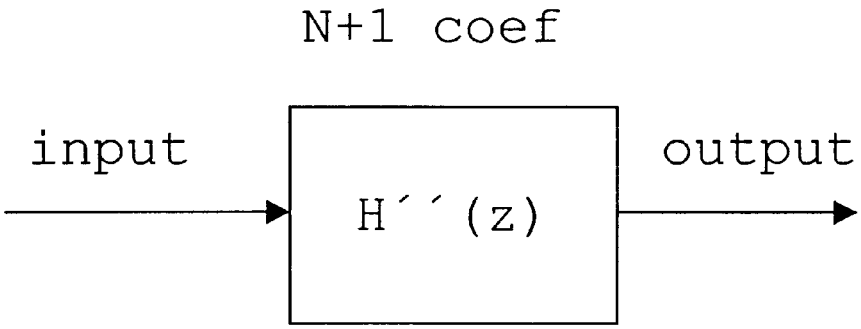
FIG. 3*b* shows a filter where the coefficients of T(z) and H(z) are convolved to form the coefficients of the filter H"(z).

One may also, instead of quantizing the a coefficient, compute a new set of coefficients $b'_1$–$b'_N$. This is possible if one observes that the tilt filter T(z) and the synthesis filter H(z) will actually be in cascade in the decoder, se FIG. 3*b*. Thus one can convolve the filter coefficients of the filters $$1+az^{-1} \tag{9}$$

and $$1 + \sum_{n=1}^{N} b_n z^{-n} \tag{10}$$

The convolution operation is assumed to be well known to anyone familiar with the subject of signal processing. Equation (9) is the same as 1/T(z), apart from the term G. Equation 10 equals 1/H(z). The goal is to unite, when there are two cascaded filters according to FIG. 3*a*, said filters using a convolution operation on the filter coefficients in order to produce a filter according to FIG. 3*b*. The filter in FIG. 3*b* will be of an higher order, i.e. with more coefficients than H(z). The resulting filter has N+1 coefficients and is of the form $$1 + \sum_{n=1}^{N+1} b''_n z^{-n} \tag{11}$$

and could thus be incorporated in block 515 for non-active mode in FIG. 5*a*.

Figure 3C:
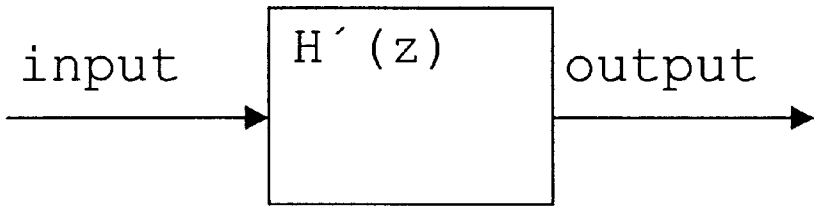
FIG. 3*c* shows a filter H'(z) where the number of coefficients is reduced to N in order to enable quantisation with an existing quantiser.
Figure 4:
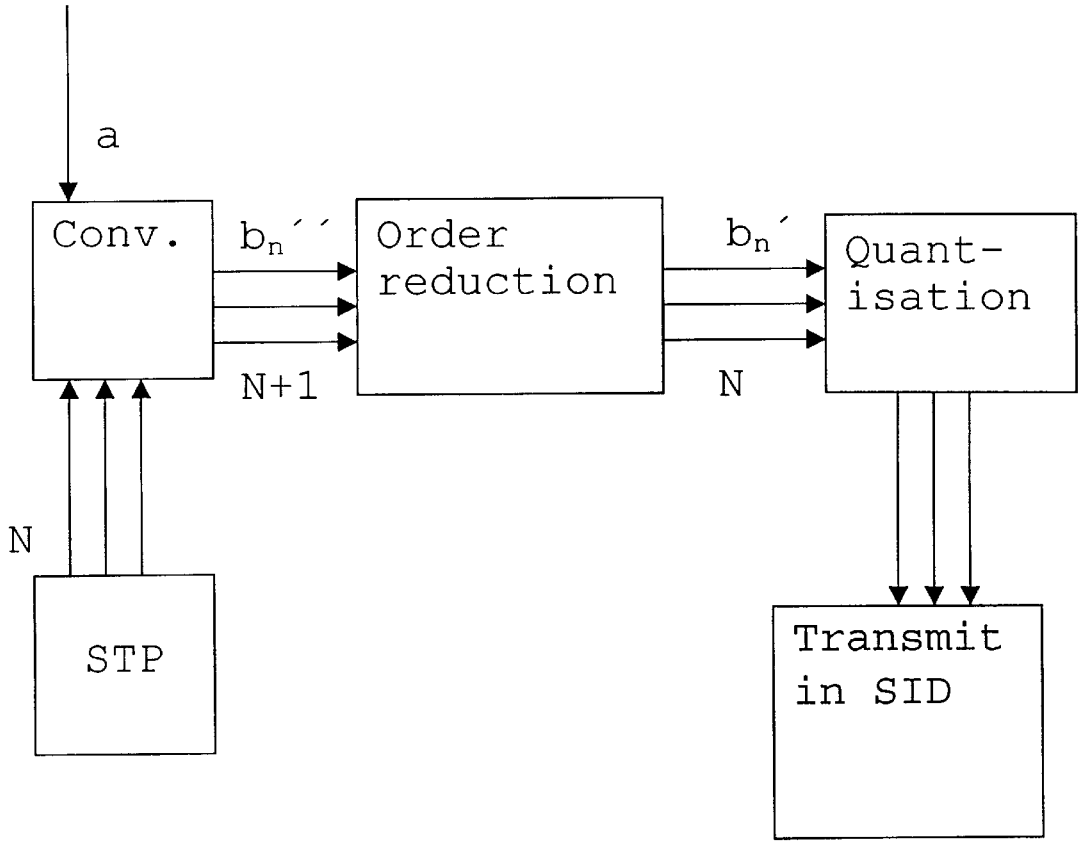
FIG. 4 shows a block diagram of the convultional procedure.

In order to alleviate the quantisation of the coefficients with existing quantisation tables, which are built on a fixed number of N coefficients, the number of coefficients in equation (11) must be reduced, to give a reduced filter H'(z), see FIG. 3*c*, with the order N, where $$H'(Z) = \frac{G}{1 + \sum_{n=1}^{N} b'_n z^{-1}} \tag{12}$$

The procedure of reducing the filter order is well known to anyone familiar with the subject of signal processing and speech coding and is performed in block 515 of FIG. 5. The resulting coefficients of the cascaded filter of order N ($b_1' \ldots b_N'$) are then quantized together with an energy parameter and transmitted. The ordinary amount of parameters has thus been maintained for the tilt filter. The G value does not have to be quantized either, as the frame energy is taken care of by the dedicated energy parameter. At the receiver, the energy parameter decides the level of a noise signal, which is obtained from the filter H'(z), the coefficients of which are $b_1' \ldots b_N'$. The output signal is then fed to a loudspeaker.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for processing an incoming signal to generate comfort noise, said method comprising the steps of:

encoding the incoming signal to generate said comfort noise;

before encoding, tilting a spectrum of the signal so that low frequency components are amplified when the incoming signal contains harmonic noise, in order to enhance the generated comfort noise; and scaling the incoming signal with a gain factor to ensure that a perceived level remains constant despite the tilt operation.

2. The method of claim 1, further comprising the step of computing a maximum long term correlation of the incoming signal for use in determining the degree of amplification of the low frequency components.

3. The method of claim 1, further comprising the step of computing a spectral tilt factor for use when computing coefficients representing the comfort noise, said spectral tilt factor is dependant on an open loop LTP maximum long term correlation of the signal.

4. The method of claim 3, further comprising the steps of quantizing and transmitting the spectral tilt factor "a" by:

calculating the open loop long term predictor (LTP) maximum long term correlation;

filtering the signal using the spectral tilt factor "a" in a z-domain as given by $$T(z) = \frac{G}{1 + az^{-1}},$$

wherein T(z) is a tilt filter and G is a gain factor;

producing short term predictor (STP)-coefficients from the filtered signal; and transmitting the STP-coefficients.

5. The method of claim 4, wherein the STP-coefficients are quantized before the transmission to the receiver.

6. The method of claim 1, wherein said step of tilting further includes the steps of:

calculating a set of coefficients $b_1, \ldots, b_N$ for a synthesis filter (H(z));

calculating a coefficient "a" for a tilt filter (T(z));

calculating N+1 coefficients $b''_1, \ldots, b''_{N+1}$ of a resulting filter having the form $$1 + \sum_{n=1}^{N+1} b''_n z^{-n};$$

reducing an order of the resulting filter to produce N coefficients $b'_1$, $b'_N$; and quantizing and transmitting the reduced number of coefficients $b_1'$–$b_N'$.

7. A method for telecommunication comprising the steps of:

detecting whether an incoming signal is speech or background noise;

subjecting the incoming signal to a tilting operation to generate comfort noise, said tilting operation including:

computing parameters "a" and "G" from a function {a, G}=F(C);

determining a long term correlation using the incoming signal;

computing a coefficient a' using a maximum long term correlation (C);

smoothing the coefficient a';

tilting the incoming signal so that low frequencies are amplified when the background noise contains harmonic noise, and scaling the signal with the gain "G" to ensure that a perceived level remains constant despite the tilt operation;

encoding and transmitting the background noise and encoding and transmitting the speech.

8. The method of claim 7, wherein before the encoding of the background noise the incoming signal is subjected to a tilting operation in order to increase the low frequency components.

9. The method of claim 8, wherein a degree of reducing the low frequency components is determined by a maximum long term correlation of the incoming signal.

10. The method of claim 8, wherein the tilting operation implements the function $$T(z) = \frac{G}{1 + az^{-1}},$$

where "a" is a tilt factor, which is calculated depending on a maximum long term correlation, T(z) is a tilt filter, and G is a gain factor.

11. The method of claim 10, wherein "a" is slowly varying between 0 and −1 inclusive.

12. The method of claim 7, further comprising:

a long term predictor (LTP) analysis to produce a maximum long term correlation and a STP-analysis are made on the incoming signal; and for background noise, parameters obtained in the STP-analysis are modified in accordance with a value of the maximum long term correlation.

13. The method of claim 12, wherein a tilt parameter is calculated from the maximum long term correlation and the STP-parameters and the tilt parameter are combined to form a new set of STP-parameters using a convolution operation of a filter corresponding to the tilt parameter and a filter corresponding to the STP-parameters.

14. The method of claim 7, wherein $a' = -\min(1, 7c^2; 0, 9)$, a=0, 8a+0, 2a', G=1+0,7a.

15. The method of claim 7, wherein a'=−min(1, max(0, C−0,3)/0,2)*0,7, a=0, 8a+0,2a', G=1+0,7a.

16. A system for processing an incoming signal to generate comfort noise, said system comprising:

a device for tilting a spectrum of the signal so that low frequencies are amplified when the incoming signal contains harmonic noise, in order to enhance the generated comfort noise; and means for scaling the incoming signal with a gain factor to ensure that a perceived level remains constant despite the tilt operation.

17. The system of claim 16, wherein said device further including means for computing at least one coefficient to enable production of the comfort noise at a receiver end of a transmission line, said at least one coefficient is dependent on an amount of tonal characteristics of the signal.

18. The system of claim 16, wherein said device further including means for computing a spectral tilt factor for use when computing coefficients representing the comfort noise, said spectral tilt factor is dependent on an open loop LTP maximum long term correlation of the signal.

19. The system of claim 18, wherein said device is further operable to quantize and transmit the spectral tilt factor by using:

a speech coder for calculating the open loop LTP maximum long term correlation;

a tilt filter T(z) for filtering the signal in a z-domain which is $$T(z) = \frac{G}{1 + az^{-1}},$$

wherein a is the tilt factor and G is a gain factor;

a decoder for determining STP-coefficients of a synthesis filter, said decoder having a form $$H(z) = \frac{1}{1 + \sum_{n-1}^{N} b_n z^{-n}};$$

and a receiver operable to receive the coefficients $b_1$–$b_n$ from the decoder.

20. The system of claim 19, wherein said device further capable of quantizing the coefficients $b_1$–$b_n$ before transmission to the receiver.

21. A telecommunication system comprising:

a detector for detecting whether an incoming signal is speech or background noise;

means for computing parameters "a" and "G" from a function {a, G}=F(C);

means for performing a long term correlation using the incoming signal;

means for computing a coefficient a' using a maximum long term correlation (C);

means for smoothing the coefficient a';

means for tilting the income signal so that low frequencies are amplified when the background noise contains harmonic noise;

means for scaling the signal with the gain "G" to ensure that a perceived level remains constant despite the tilt operation; and an encoder for encoding and transmitting the background noise for encoding and transmitting the speech.

22. The telecommunication system of claim 21, further comprising means for tilting the incoming signal to increase the low frequency components before the encoding of the background noise.

23. The telecommunication system of claim 22, further comprising means for determining a degree of reducing the low frequency components from a maximum long term correlation of the incoming signal.

24. The telecommunication system of claim 22, wherein the tilting means implements the function $$T(z) = \frac{G}{1 + az^{-1}},$$

where "a" is a tilt factor, which is calculated depending on the maximum long term correlation.

25. The telecommunication system of claim 24, wherein "a" is slowly varying between 0 and −1 inclusive.

26. The telecommunication system of claim 21, further comprising:

means for performing a long term predictor (LTP) analysis to produce a maximum long term correlation and for performing a STP-analysis on the incoming signal; and means, which, for background noise, modifies the parameters obtained in the STP-analysis in accordance with a value of the maximum long term correlation.

27. The telecommunication system of claim 26, further comprising:

means for calculating a tilt parameter from the maximum long term correlation; and means for combining the STP-parameters and the tilt parameter to form a new set of STP-parameters using a convolution operation of a filter corresponding to the tilt parameter and a filter corresponding to the STP-parameters.

28. The telecommunication system of claim 21, wherein a'=−min(1,7c$^2$, 0, 9), a=0, 8a+0, 2a', G=1+0,7a.

29. The telecommunication system of claim 21, wherein a'=−min(1, max(0,C−0,3)/0,2)*0,7, a=0

* * * * *

UNITED STATES PATENT AND TRADEMARK OFFICE

CERTIFICATE OF CORRECTION

PATENT NO. : 6,424,942 B1
DATED : July 23, 2002
INVENTOR(S) : Mustel et al.

It is certified that error appears in the above-identified patent and that said Letters Patent is hereby corrected as shown below:

Column 7,
Formula (8),

Replace " $H(Z) = \dfrac{1}{1+\sum_{n-1}^{N} b_n z^n}$ "

with -- $H(Z) = \dfrac{1}{1+\sum_{n-1}^{N} b_n z^{-n}}$ --

Formula (10),

Replace " $1+\sum_{n=1}^{N} b_{r_1} z^n$ "

with -- $1+\sum_{n=1}^{N} b_{r_1} z^{-n}$ --

Column 8,
Line 58, replace “dependant” with -- dependent --

UNITED STATES PATENT AND TRADEMARK OFFICE

CERTIFICATE OF CORRECTION

PATENT NO. : 6,424,942 B1
DATED : July 23, 2002
INVENTOR(S) : Mustel et al.

It is certified that error appears in the above-identified patent and that said Letters Patent is hereby corrected as shown below:

Column 11,
Line 16, after "noise" insert -- and --

Column 12,
Line 28, after "a=0" insert -- , 8a + 0, 2a′,G = 1+ 0, 7a . --

Signed and Sealed this

Fifteenth Day of April, 2003

JAMES E. ROGAN
*Director of the United States Patent and Trademark Office*